United States Patent [19]

Baker

[11] Patent Number: 4,733,549

[45] Date of Patent: Mar. 29, 1988

[54] THEFT PREVENTING LUGGAGE HANDLE ATTACHMENT

[76] Inventor: Franklin W. Baker, 6265 S. LaBrea Ave., Los Angeles, Calif. 90056

[21] Appl. No.: 47,276

[22] Filed: May 8, 1987

[51] Int. Cl.[4] ..... E05B 67/38

[52] U.S. Cl. ..... 70/68; 70/207; 70/69

[58] Field of Search ..... 70/207, 208, 68, 158, 70/69, 57, 58; 190/39, 903, 101, 115, 116, 117, 118; D8/322, 321, 300

[56] References Cited

U.S. PATENT DOCUMENTS

| | | | |
|---|---|---|---|
| 959,235 | 5/1910 | Lemieux | 190/115 |
| 1,261,159 | 4/1918 | Olwell | 190/115 |
| 2,274,536 | 2/1942 | Doppelt | 190/115 |
| 2,310,627 | 2/1943 | Greene | 70/68 |
| 3,141,536 | 7/1964 | Fulton | 70/68 |

FOREIGN PATENT DOCUMENTS

| | | | |
|---|---|---|---|
| 19684 | of 1896 | United Kingdom | 190/39 |

*Primary Examiner*—Robert L. Wolfe

*Attorney, Agent, or Firm*—Albert O. Cota

[57] ABSTRACT

A theft preventing attachment for a luggage handle defining, in the preferred embodiment, a resilient sheath (20) split in the middle with a ZIPPER (24) effectively covering the luggage handle when closed and secured with a lock (32). The second embodiment incorporating a hood (36) with a lock (42) covering the luggage handle such that only a smooth surface exists, making lifting impossible from the handle. The third embodiment applying a tumbler lock (50) with the pawl penetrating a cavity (52) in the handle keeping it in the closed or retracted position. In either event, carrying of luggage so locked would indicate a theft was taking place, overcoming the problem of unauthorized stealing of unattended luggage.

8 Claims, 39 Drawing Figures

THEFT PREVENTING LUGGAGE HANDLE ATTACHMENT

TECHNICAL FIELD

This invention relates to covers that create a smooth surface or locks that disallow gripping of the handle in general, and more specifically to a luggage handle attachment to prevent unauthorized transportation by inaccessibility of the handle.

Since the advent of travel in general, and the popularity of surface or air transportation some difficulty has existed in passenger loading terminals where individual luggage pieces are hand carried and must be in one's possession. The problem arises that when the traveler must, of necessity, leave the articles unattended for short periods of time, to go to the ticket area, food counter, restroom, or a telephone, etc., a thief simply picks up the luggage and carries it away unnoticed.

Prior art has done little for protecting the articles in regard to this problem, as locks to prevent opening of the luggage are of no avail and terminal facilities have not provided sufficiently adequate security measures during this period of time. A search of prior art has not disclosed any patents that are specific to the utility on hand luggage, however, some of the structure was considered related in independent form in the following U.S. Patents.

| U.S. Pat. No. | Inventor | Issue Date |
|---|---|---|
| 4,514,884 | Kaneko | May 7, 1985 |
| 4,244,086 | Gregg | Jan. 13, 1981 |
| 4,288,666 | Perez-Alonso | Oct. 21, 1980 |
| 4,213,314 | Trader | Jul. 22, 1980 |
| 4,062,207 | Bonner | Dec. 13, 1977 |
| 720,803 | Herrmann | Feb. 17, 1903 |

Kaneko teaches a double slider fastening lock including a catch plate having a long hole capable of inserting the head of a corresponding slider. This lock is attached to the slider of a so-called ZIPPER by its registered trademark.

Gregg discloses a locking member that is secured permanently to one ZIPPER operator as a pull tab and is selectively positionable into a second pull tab of another ZIPPER operator when the two are located in juxtaposition.

Perez-Alonso is concerned with safety closures that incorporates a male latch pin which is inserted into a female receptacle under pressure retaining the handle in a closed position by the action of a ratchet apparatus in a hinge mechanism of the lid.

Trader teaches locking devices for handbags in which one end of the carrying strap contains a lock bolt which inserts into a lock attached to the handbag. The ZIPPER slide fastener contains a ring on the handle portion that interfaces with the lock bolt securing the interlocked fastener in the closed position.

Bonner, finally, is concerned with a zippered opening flexible walled security bag having a lock that secures the slide fastener in the locked position preventing button holing of the attachment means and back feeding of the lock and slide fastener.

For background purposes and as indicative of the art to which the invention relates, reference may be made to the remaining cited patents.

It will be noted that the prior art uses ZIPPERS for fastening and closing the bags while the method of holding the slide fastener secure comprises most of the novelty. It is evident from this search that protecting luggage by making the handle inaccessible is indeed unique and patentable.

DISCLOSURE OF THE INVENTION

Since hand carrying luggage is the normal procedure in passenger terminals, and identification is not always required, entering or leaving it is not considered unusual for a person having the appearance of a traveler to pick-up an unattended bag and be lost in the crowd. This problem of theft in this manner is overcome by covering the handle of the luggage not allowing a gripping surface to be available. While this method of protection does not completely stop theft, it does make it very awkward to carry a piece of luggage without a handle and identifies the unauthorized movement to others, particularly to trained security personnel. A thief would look toward easier prey if given the choice, and even straps, hooks, etc., would be easily identified as an illegal act in process.

An important object of the invention allows the traveler to only carry a key when leaving the luggage, which is all that is necessary, and is easily placed in ones pocket or purse. The handle covering mechanism is either integral with the suitcase in one embodiment, or is completely separate and transported therein in another.

A further object of the invention allows the use of commercially available locking mechanisms eliminating costly tooling and production development.

Another object of the invention, and solution to the problem, requires little or no modification to conventional hand carried luggage. In one embodiment a cover is permanently attached and in another a separate device is utilized only when needed and stored inside with a third embodiment incorporating a permanent lock and attachment rotated or positioned to hold the handle in the retracted position.

Still another object of the invention announces to others, by its presence, that the owner is nearby and is returning at any moment and gives visual indication to all present of those intentions.

These and other objects and advantages of the present-invention will become apparent from the subsequent detailed description of the preferred embodiment and the appended claims taken in conjunction with the accompanying drawings.

BEST MODE FOR CARRYING OUT THE INVENTION

Figure 1:
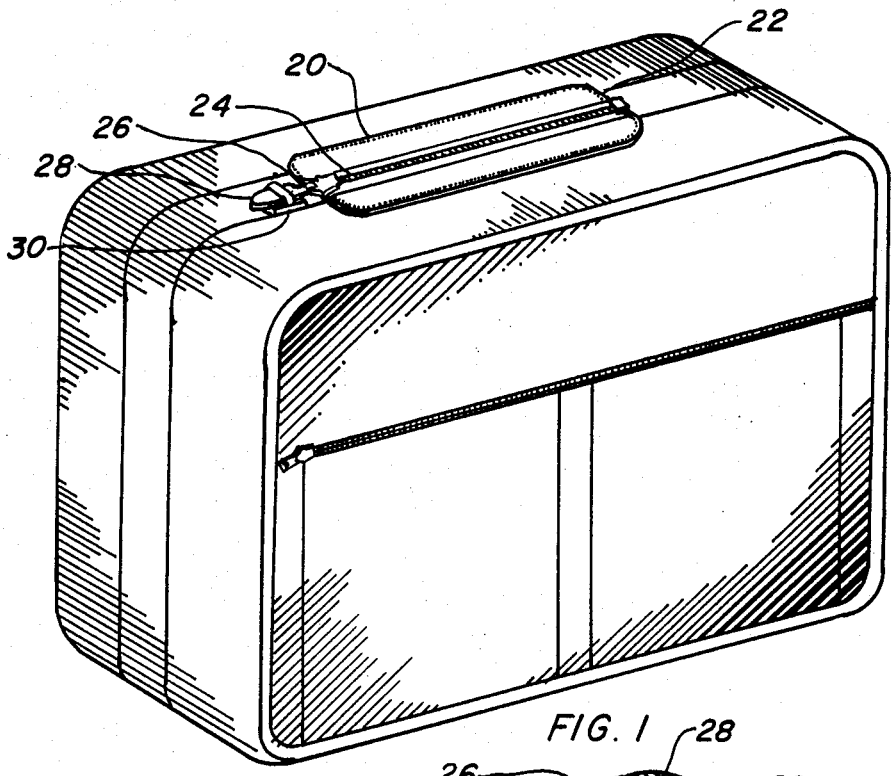
FIG. 1 is a partial isometric view of the preferred embodiment integral with a suitcase and in the secured position.
Figure 2:
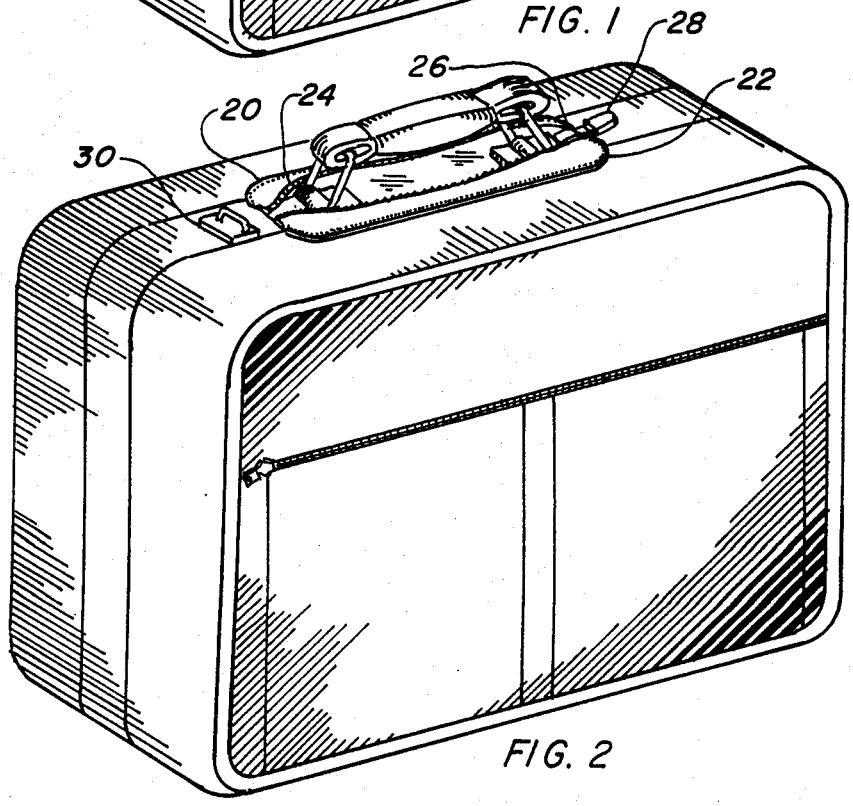
FIG. 2 is a partial isometric view of the preferred embodiment integral with a suitcase in the open position with the handle extended in the normal carrying position.
Figure 3:
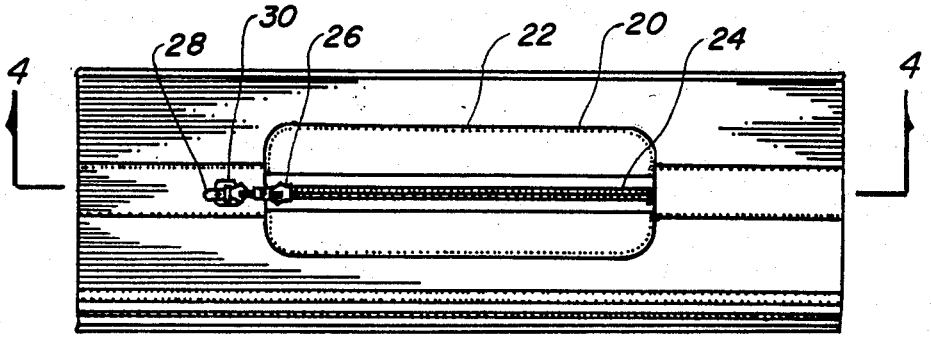
FIG. 3 is a plan view of the preferred embodiment.

The best mode for carrying out the invention is presented in terms of a preferred, second and a third embodiment. The first two embodiment are primarily designed with the same covering, except on some suitcases the handle collapses and others rotate flat when not in use.

The preferred embodiment, as shown in FIGS. 1 through 6 is comprised of a resilient sheath 20 having an inside and an outside, split in the middle into two pieces. This embodiment is adaptable to suitcases where the handle collapseswhen not in use. The sheath 20 completely encloses the handle providing no gripping surface to lift the luggage. The sheath 20 is attached to the luggage by sewing with thread 22 in the form of stitching with a machine well known in the art.

A two part interlocked fastener 24, known commonly by its trademarked name ZIPPER joins each sheath piece 20 together. The ZIPPER 24 has two interlocking fasteners joined by sewing to each side of the sheath 20 and is separated or united by the ZIPPERS sliding device with a manual tab 26 having an aperture therein. There are two embodiments of the locking mechanism to affix the ZIPPER to the luggage. The first is illustrated in FIGS. 1 through 4 and consists of a lock in the form of a spring loaded retractable keyed latch 28 that pivots inward by compressing the spring, and is permanently, but pivotly, attached through the aperture in the tab 26 of the ZIPPER 24. A lock hasp 30, in the form of an extended loop, is affixed to the luggage adjacent to the sheath 20 and the latch 28 penetrates the loop, rebounding outwardly under locking spring pressure creating an interference, disallowing removal from the loop of the lock hasp 30, unless a key is inserted into the latch 28 allowing the spring to retract. In operation the owner, when leaving the luggage, simply zips the interlocked fastener 24 closed and pushes the keyed latch 28 into the hasp 30 enclosing the collapsible handle, leaving a smooth contoured surface inaccessible for gripping.

Figure 5:
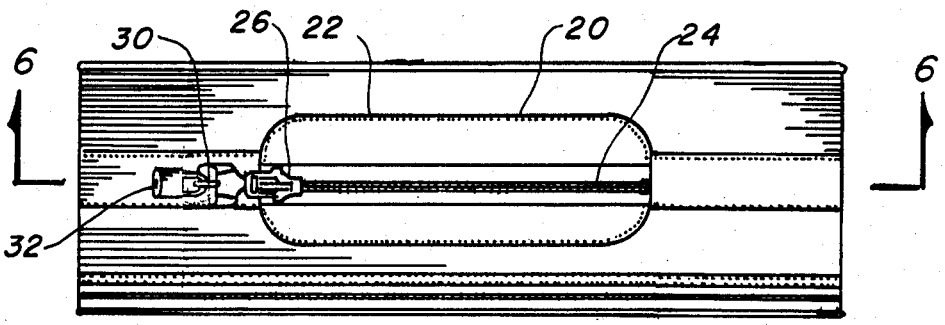
FIG. 5 is a partial plan view of the preferred embodiment.
Figure 6:
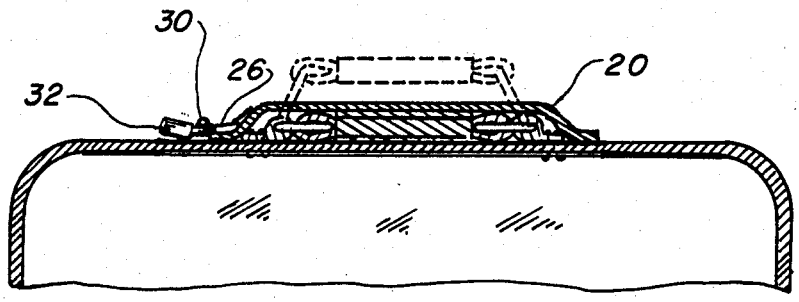
FIG. 6 is a cross-sectional view taken along lines 6—6 of FIG. 5 with the handle shown dashed in the extended position.
Figure 7:
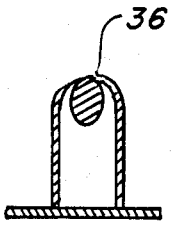
FIG. 7 is a cross-sectional view taken along lines 7—7 of FIG. 10.
Figure 8:
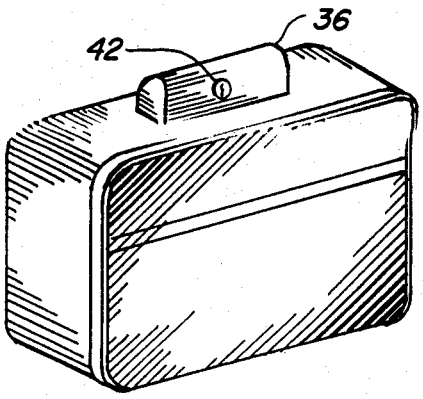
FIG. 8 is a partial isometric view of the second embodiment attached to a suitcase.
Figure 9:
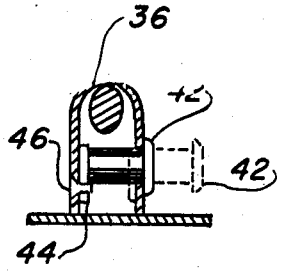
FIG. 9 is a cross-sectional view taken along lines 9—9 of FIG. 10.
Figure 10:
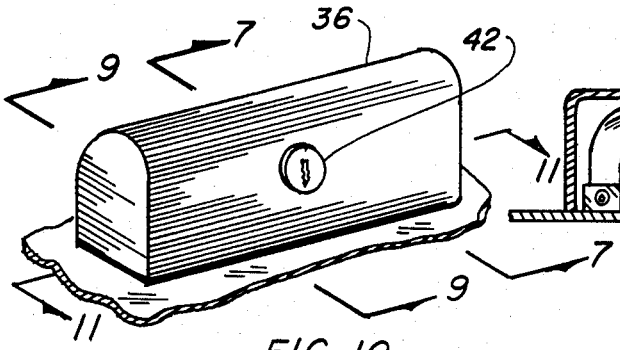
FIG. 10 is a partial isometric view of the second embodiment with the suitcase cut-away for clarity.
Figure 11:
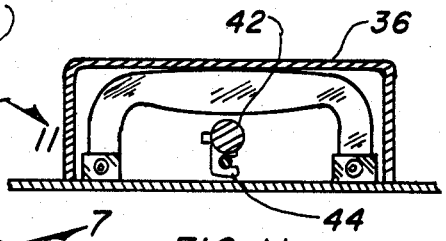
FIG. 11 is a cross-sectional view taken along lines 11—11 of FIG. 10.
Figure 12:
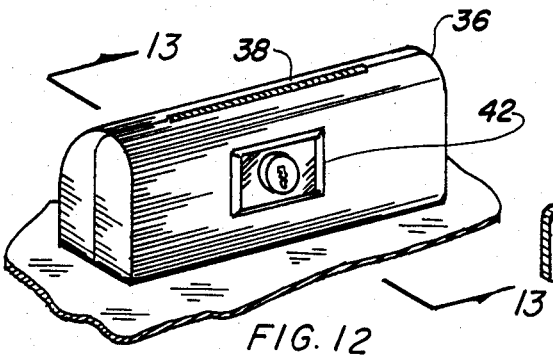
FIG. 12 is a partial isometric view of the second embodiment in the hinged configuration with the suitcase cut-away for clarity.
Figure 13:
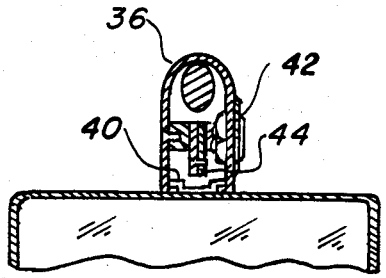
FIG. 13 is a cross-sectional view taken along lines 13—13 of FIG. 12.

The second embodiment of the locking mechanism affixed to the ZIPPER is illustrated in FIGS. 5 and 6 and places the aperture in the sliding device 26 of the ZIPPER 24, directly over the lock hasp 30, which is small enough to penetrate therethrough leaving the loop exposed on top of the tab. A lock 32, in the form of a padlock either keyed or numerical combination, is placed with the U-bolt portion through the exposed loop of the hasp 30 on top of the tab 26. The operation is exactly the same, except the lock 32 is removed from its normal storage place in the hasp 30, and the tab 26 is pulled closed over the collapsed handle of the luggage, then the lock 32 is replaced in the hasp 30.

Figure 4:
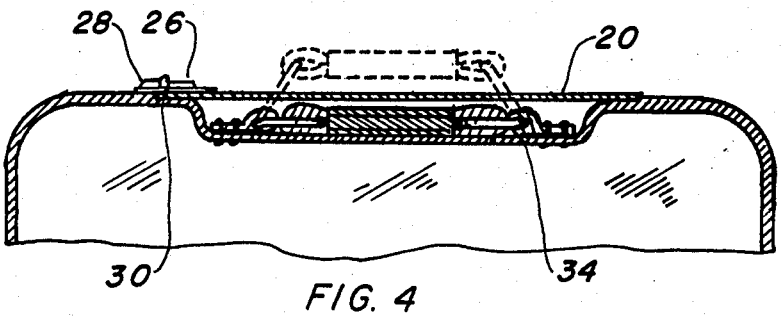
FIG. 4 is a cross-sectional view taken along lines 4—4 of FIG. 3 with the handle shown dashed in the extended position.

A slight variation in either embodiment is illustrated in FIG. 4 and consists of a recessed compartment in the luggage allowing the handle to be flush with the sheath 20 when it is retracted flat. This requires the luggage to be manufactured with this alteration with the advantage of a smooth appearance on the top surface. A slightly longer handle is required to allow ease of grasping when it is extended through the sheath 20.

The second embodiment of the invention is illustrated pictorially in FIGS. 7 through 15 and consists of a rigid hood structure 36 just large enough on the inside to slip over the luggage handle completely enclosing the handle, allowing no gripping surface to be available. The hood 36 is either unitary, as shown in FIGS. 7 through 11, or is optionally split in the middle into two equal parts, having a hinge 38 holding the parts together. When the hinge 38 is used, removal from the luggage is accomplished by axially rotating each half away from the handle in clam shell manner. Further, if desired, a pair of locking brackets 40 may be used, but are not entirely necessary for operation of the invention. These brackets 40 are permanently attached to the luggage and interface with the hood 36 allowing a rigid and secure attachment when the cover is rotated closed. This method of attachment is important when the configuration of the handle is somewhat different than the inside shape of the hood 36 and the fit would otherwise be loose allowing a slight gripping surface to exist between the hood 36 and the luggage.

In either event, a keyed lock 42 having a rotating hasp is disposed within the hood structure 36 beneath the luggage handle such that an interference is created therebetween not allowing the hood 36 to be removed when the lock 42 is in place. The lock 42 may be utilized by two methods, the first, illustrated in FIGS. 7 through 11, incorporates a slideable rotating hasp 44 and a tab 46 on the inside of the hood 36. The tab 46 is grasped by the hasp 44 when rotated by a key inserted into the lock 42. This attaches the two together and restricts movement, accomplishing the locking feature. When removal is desired, the key is placed into the lock 42 and the hasp 44 is rotated then slideably moved away from the hood 36, as illustrated in a dashed location in FIG. 9. This allows the hood 36 to be removed by simply lifting away from the handle. It will be noted that a key and keyway, or a spline, and an accompanying splined hole, or a similar method must be utilized to prevent the lock 42 from rotating within the interface with the hood 36.

Figure 14:
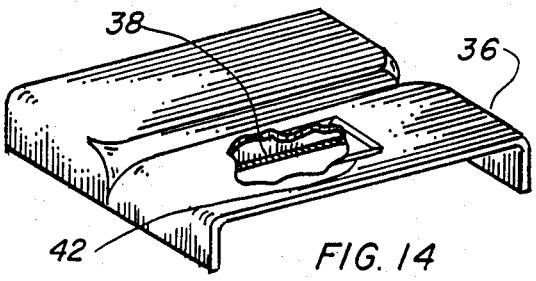
FIG. 14 is a view of the second embodiment in the hinged configuration removed from the suitcase, and in the opened position for storage.
Figure 15:
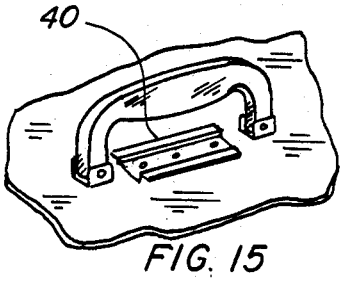
FIG. 15 is a view of the modifications to the suitcase required for use with the hinged configuration of the second embodiment.
Figure 16:
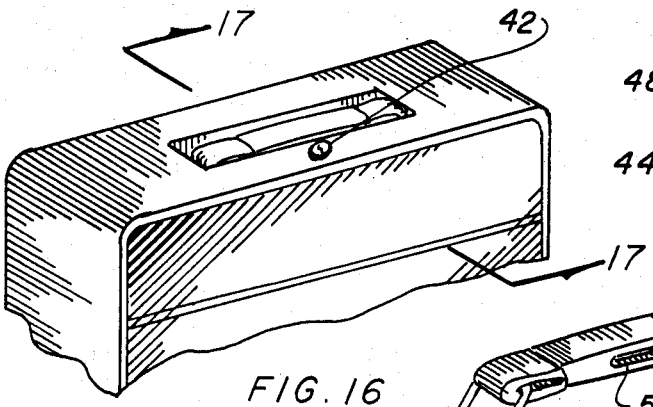
FIG. 16 is a partial isometric breakaway view of the recessed handle compartment with a tumbler lock engaging a collapsible handle.
Figure 17:
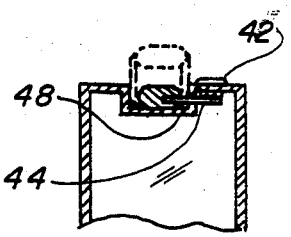
FIG. 17 is a cross-section view taken along lines 17—17 of FIG. 16.

The second method of lock utilization is illustrated in FIGS. 12 through 15, and the lock 42 is similar in nature, except it extends only halfway from one side of the hood 36. The tab 46 extends also halfway from the other side of the hood 36 interfacing in the middle. This allows the lock 42 to be secured in a normal manner with lock rings or nuts, normally furnished with the lock 42. The hasp of the lock 42 grasps the extended tab 46 when rotated by the key in the lock 42. As the hood 36 contains a hinge 38 in this method of locking, the tab 46 and lock 42 rotate away from each other when the hood 36 is opened, as depicted in FIG. 14.

The operation of the second embodiment is inherently obvious, as the lock 42 is rotated and either slid outwardly out of the way and the hood 36 lifted off, or simply hinged away when the lock 42 is rotated.

The third embodiment utilizes structural interference in the form of a lock that impedes the movement of the handle when it is retracted and is touching the top of the luggage. This prevents the luggage from being lifted in a normal manner as the handle is inaccessible by itself.

Figure 18:
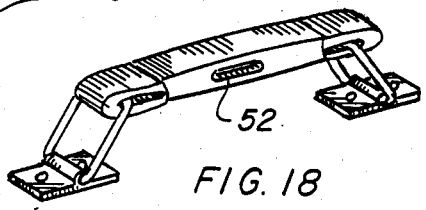
FIG. 18 is a partial isometric view of the handle of FIG. 16 illustrating the slot modification in the side thereof with the handle completely removed from the suitcase for clarity.
Figure 19:
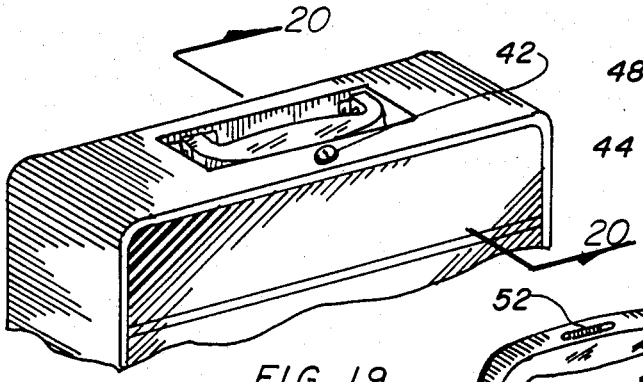
FIG. 19 is a partial isometric breakaway view of the recessed handle compartment with a tumbler lock engaging a hinged handle.
Figure 20:
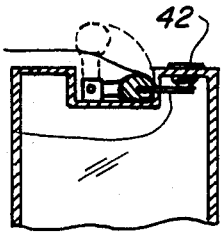
FIG. 20 is a cross-sectional view taken along lines 20—20 of FIG. 19.
Figure 21:
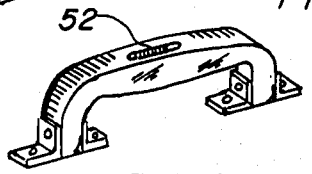
FIG. 21 is a partial isometric view of the handle of FIG. 19 illustrating the slot modification in the side thereof with the handle completely removed from the suitcase for clarity.
Figure 22:
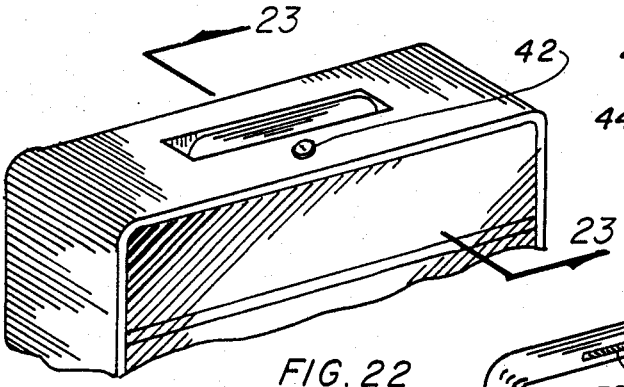
FIG. 22 is a partial isometric breakaway view of the recessed handle compartment with a tumbler lock engaging a retracting handle.
Figure 23:
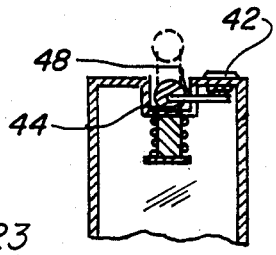
FIG. 23 is a cross-sectional view taken along lines 23—23 of FIG. 22.
Figure 24:
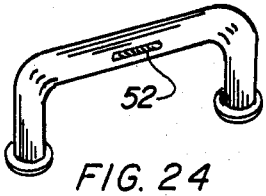
FIG. 24 is a partial isometric view of the handle of FIG. 22 illustrating the slot modification in the side thereof with the handle completely removed from the suitcase for clarity.
Figure 25:
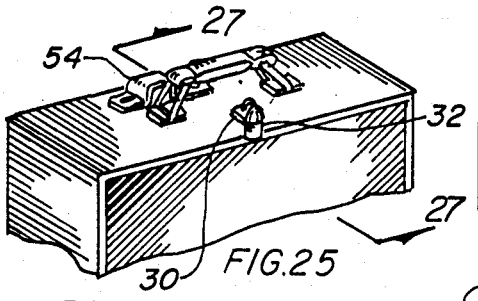
FIG. 25 is a partial isometric breakaway view of a collapsible handle with locking means in the unlocked position.
Figure 26:
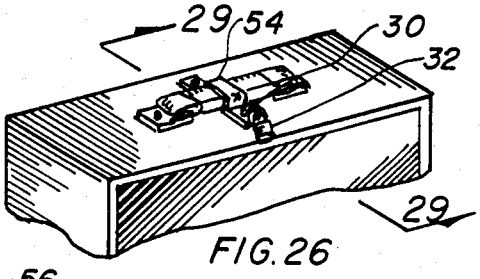
FIG. 26 is a partial isometric breakaway view of a collapsible handle with the locking means in the locked position.
Figure 27:
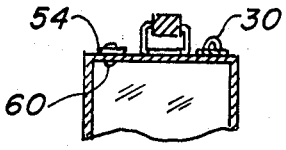
FIG. 27 is a cross-sectional view taken along lines 27—27 of FIG. 25.
Figure 28:
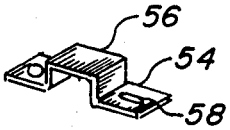
FIG. 28 is a partial isometric view of the locking means completely removed from the suitcase for clarity.
Figure 29:
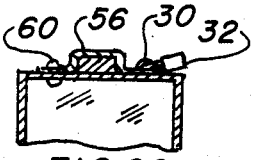
FIG. 29 is a cross-sectional view taken along lines 29—29 of FIG. 26.
Figure 30:
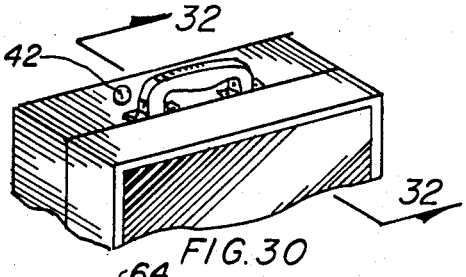
FIG. 30 is a partial isometric breakaway view of a hinged handle with locking means in the unlocked position.

This third embodiment is shown in FIGS. 16 through 39. The basic configurations are depicted in FIGS. 16 through 24 and incorporate a recessed compartment 34 in the top of the luggage slightly larger than the handle allowing the handle to be contiguous with the bottom and flush with the top. A slot 48 is contained within the side of the compartment 34 and a keyed tumbler lock 42, with a rotating pawl, is mounted through to luggage and into the interior. The pawl of the lock 42 is in line with the slot 48 and allows penetration therethrough when rotated by the key. The handle of the luggage contains a cavity 52 being collapsible by having loops on each end as shown in FIG. 18, rotatable from brackets illustrated in FIG. 21 or retractable with tension springs holding the handle extended shown in FIG. 24. The cavity 52 is located within the handle at a point adjacent to the slot 48 which may be on the top or side of the handle as applicable. In operation, the traveler when leaving the luggage inserts the key into the tumbler lock 42 rotating the pawl until it engages the cavity 52 in the handle. In the case of the handles configured in FIGS. 18 and 21, they normally collapse or rotate by themselves in the retracted position while the handle of FIG. 24 must be pushed down while the pawl is rotated. To release the lock, the reverse procedure is followed.

The other configuration of the third embodiment is depicted in FIGS. 25 through 39 and is directed to handles on the surface of the luggage again restricted in their movement by structural interference with the handle when it is retracted flat against the top. Basically a rigid member in the form of a clasp 54, a offset bracket 62 or the pawl of a tumbler lock 42 are utilized as the structural interference.

FIGS. 25 through 29 depict an embodiment wherein the handle of the luggage employs a pair of rectangular loops attached to each end of the handle which in turn contains slits allowing the handle to compress flat upon the top of the luggage. This type of handle is used commonly and is well known in the art. A clasp 54 having a raised control portion 56 and a slot 58 in the flat is formed of metal or the like in a so called hat section best shown removed from the luggage in FIG. 28. This clasp 54 is attached to the luggage with means to rotate 60 in the form of a rivet or the like that mechanically restricts movement on each side while allowing sufficient movement therebetween to allow the clasp 54 to rotate over the top of the handle.

A lock hasp 30 is attached to the luggage on the side opposite the clasp 54 and consists of a flat plate with an inverted loop extending from the plate. The clasp 54 is rotated over the handle and the slot 58 interfaces with the hasp 30 allowing the loop to protrude. A padlock 32 is placed into the loop preventing removal and the handle is captivated in a locked position.

FIGS. 30 through 34 illustrates yet another method of structural interference utilizing a handle that rotates flat. An offset bracket 62 is attached to the bottom of one end of the handle and the luggage contains an aperture 64 directly underneath the handle allowing the bracket 62 to penetrate inside. A tumbler lock 42 is positioned through the luggage adjacent to the aperture 64 such that when the handle is retracted flat against the top of the luggage, the offset bracket 62 is impeded in its movement by rotating the hasp of the lock 42 thereunder. This inteference mechanically prevents the handle from being rotated into its normal upright position for carrying.

Figure 38:
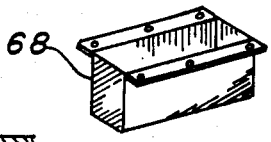
FIG. 38 is a partial isometric view of the cover for the locking means as shown in FIGS. 37 and 39 completely removed from the suitcase for clarity.
Figure 39:
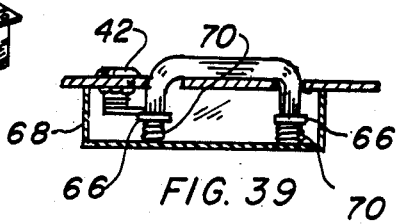
FIG. 39 is a cross-sectional view taken along lines 39—39 of FIG. 36.

The final method is shown in FIGS. 35 through 39 using a handle formed in C-shape with a flange 66 on each end. The handle penetrates the luggage in a tight but sliding fit. A box like housing 68, shown removed from the luggage in FIG. 38, is attached on the inside of the luggage directly over the handle. A pair of compression springs 70 are positioned between the housing 68 and the flange 66 on the handle urging the handle into the extended position. A tumbler lock 42 is positioned near one of the ends of the handle and when the handle is depressed manually, the spring 70 is compressed and the handle flange 66 is below the lock 42 at this position, the hasp of the lock 42 is rotated until it is in alignment with the flange 66 creating the mechanical interferenced structurally locking the handle in the depressed condition.

Figure 31:
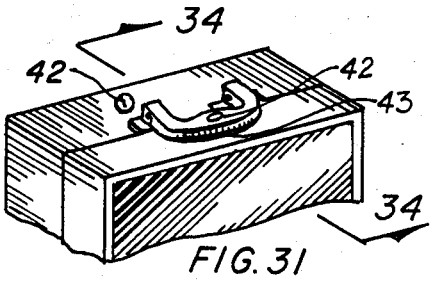
FIG. 31 is a partial isometric breakaway view of a hinged handle with locking means in the locked position.
Figure 32:
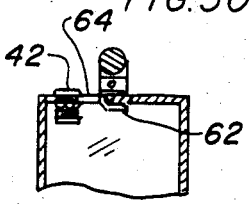
FIG. 32 is a cross-sectional view taken along lines 32—32 of FIG. 30.
Figure 33:
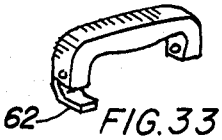
FIG. 33 is a partial isometric view of the locking means attached to the bottom of the handle with the entire assembly completely removed from the suitcase for clarity.
Figure 34:
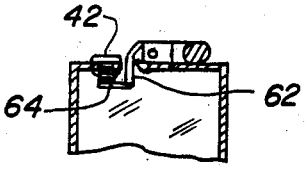
FIG. 34 is a cross-sectional view taken along lines 34—34 of FIG. 31.
Figure 35:
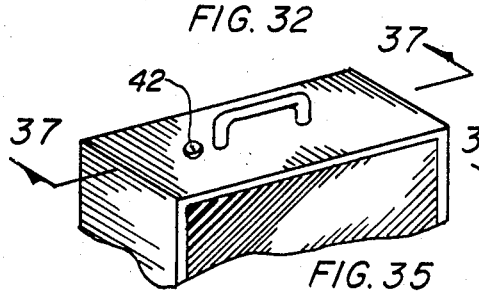
FIG. 35 is a partial isometric breakaway view of a retractable handle with locking means in the unlocked position.
Figure 36:
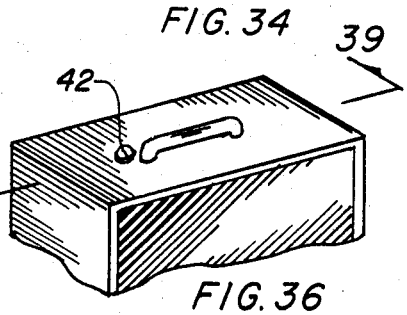
FIG. 36 is a partial isometric breakaway view of a retractable handle with the locking means in the locked position.
Figure 37:
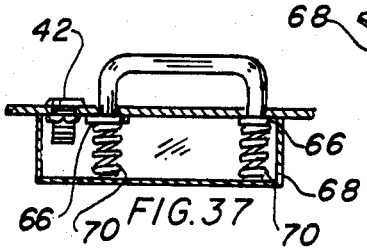
FIG. 37 is a cross-sectional view taken along lines 37—37 of FIG. 35.

While the invention has been described in complete detail and pictorially shown in the accompanying drawings, it is not to be limited to such details, since many changes and modifications may be made in the invention without departing from the spirit and the scope thereof. For example, a lock 42 can be centrally located on the side of the handle as shown in FIG. 31. When the handle is folded on its side, the lock 42 makes contact with a corresponding locking means 43 concentrically located on the case surface. Thus, holding the handle firmly against the surface of the case. Hence, it is described to cover any and all modifications and forms which may come within the language and scope of the appended claims.

I claim:

1. A theft prevention attachment for a handle attached to luggage comprising:

(a) a resilient sheath, having an inside and an outside split in the middle into two pieces, completely enclosing the luggage handle such that no gripping surface is available for lifting the luggage;

(b) means for attaching said sheath to the luggage on the inside surface maintaining the nonsubsistant gripping surface thereupon;

(c) a two part interlocked fastener comprising a sliding device with a manual tab having an aperture therein, one part joined to each sheath piece separated by the sliding device with the manual tab pulled along between the pieces allowing the handle to protrude beyond the sheath when opened, for gripping, while maintaining its inaccessible integrity when closed;

(d) a lock attached to the aperture in said manual tab of the sliding device for restraining the manual tab in a locked position; and, (e) a lock hasp in the form of an extended loop affixed to said luggage adjacent to the sheath distending outwardly with said lock penetrating therethrough defining a restraint, preventing the opening of the sheath detering theft of the luggage when left unattended.

2. The attachment as recited in claim 1 wherein said means for attaching said sheath to the luggage further comprises thread sewn in the form of a seam on the periphery of said sheath.

3. The attachment as recited in claim 1 wherein said lock further comprises a spring loaded retractable keyed latch that pivots inward by compressing the spring when urged into said extended loop of the lock hasp and rebounds outward into an interference under spring influence to create securement therewith.

4. The attachment as recited in claim 1 further comprising a recessed compartment in said luggage allowing the handle to be flush with the sheath when retracted therein.

5. A theft prevention attachment for a handle attached to luggage comprising:

(a) a resilient sheath having an inside and an outside split in the middle into two pieces completely enclosing the luggage handle such that no gripping surface is available for lifting the luggage;

(b) means for attaching said sheath to the luggage on the inside surface maintaining the nonsubsistant gripping surface thereupon;

(c) a two part interlocked fastener comprising a sliding device with a manual tab having an aperture therein, one part joined to each sheath piece separated by the sliding device with the manual tab pulled along between the pieces allowing the handle to protrude beyond the sheath when opened, for gripping, while maintaining its inaccessible integrity when closed;

(d) a lock hasp in the form of an extended loop affixed to said luggage adjacent to the sheath distending outwardly interfacing through the aperture in said manual tab when closed such that a union is made therebetween; and, (e) a lock disposed within the limits of the extended loop in the lock hasp retraining the manual tab in a locked position prohibiting opening of the sheath detering theft of the luggage when left unattended.

6. The attachment as recited in claim 5 wherein said means for attaching said sheath to the luggage further comprises thread sewn in the form of a seam on the periphery of said sheath.

7. The attachment as recited in claim 5 wherein said lock further comprises a padlock having a U-bolt and means to lock that interfaces through said manual tab impeding the withdrawal from said loop of the lock hasp when manually positioned therein in such a manner as to prevent unauthorized removal without the properly identified means to lock.

8. The attachment as recited in claim 5 further comprising a recessed compartment in said luggage allowing the handle to be flush with the sheath when retracted therein.

* * * * *